US005582445A

United States Patent [19]

Olsen et al.

[11] Patent Number: 5,582,445

[45] Date of Patent: Dec. 10, 1996

[54] SASH LOCK

[75] Inventors: Carl J. Olsen, Hudson, Wis.; William L. Zemke, Forest Lake, Minn.

[73] Assignee: Andersen Corporation, Bayport, Minn.

[21] Appl. No.: 633,258

[22] Filed: Apr. 24, 1996

Related U.S. Application Data

[63] Continuation of Ser. No. 407,404, Mar. 17, 1995, which is a continuation of Ser. No. 13,572, Feb. 4, 1993.

[51] Int. Cl.[6] ..... E05C 3/04

[52] U.S. Cl. ..... 292/241; 292/DIG. 38

[58] Field of Search ..... 292/DIG. 38, DIG. 20, 292/DIG. 47, 240, 241, 242; 49/445

[56] References Cited

U.S. PATENT DOCUMENTS

| | | | |
|---|---|---|---|
| 110,733 | 1/1871 | Breckenridge . | |
| 112,717 | 3/1871 | Judd . | |
| 126,754 | 5/1872 | Sparks . | |
| 197,848 | 12/1877 | Griscom . | |
| D. 211,452 | 6/1968 | Petrell | D10/10 |
| D. 295,019 | 4/1988 | Bocson | D8/337 |
| D. 295,948 | 5/1988 | Mandell | D8/337 |
| D. 316,509 | 4/1991 | Nolte | D8/337 |
| 564,426 | 7/1896 | Hubbard . | |
| 1,122,026 | 12/1914 | O'Rourke . | |
| 2,135,105 | 11/1938 | Knauff | 292/241 X |
| 2,422,723 | 6/1947 | Fisher | 292/241 X |
| 3,645,573 | 2/1972 | Strang | 292/DIG. 38 X |
| 3,811,718 | 5/1974 | Bates | 292/DIG. 38 X |
| 4,095,829 | 6/1978 | Van Klompenburg | 292/241 |
| 4,253,688 | 3/1981 | Hosooka | 292/52 |
| 4,610,472 | 9/1986 | Billingsley | 292/54 |
| 4,611,841 | 9/1986 | Ravinet | 292/241 |
| 4,621,847 | 11/1986 | Paulson et al. | 292/199 |
| 4,801,164 | 1/1989 | Mosch | 292/DIG. 47 x |
| 5,042,855 | 8/1991 | Bennett et al. | 292/241 |
| 5,087,087 | 2/1992 | Vetter et al. | 292/48 |
| 5,219,193 | 6/1993 | Piltingsrud | 292/240 |

FOREIGN PATENT DOCUMENTS

| | | | |
|---|---|---|---|
| 0424204 | 4/1991 | European Pat. Off. . | |
| 1377840 | 9/1964 | France . | |
| 1400209 | 2/1969 | Germany . | |
| 3010012 | 10/1980 | Germany | 292/241 |
| 329937 | 5/1930 | United Kingdom . | |
| 519411 | 3/1940 | United Kingdom . | |
| 834118 | 5/1960 | United Kingdom . | |
| 1069022 | 5/1967 | United Kingdom . | |
| 2185520 | 7/1987 | United Kingdom . | |

OTHER PUBLICATIONS

Andersen Corporation catalog, "A Complete Guide to Andersen Windows & Patio Doors", 1990, Second Printing, p. 87.

*Primary Examiner*—Kenneth J. Dorner
*Assistant Examiner*—Jerry Redman
*Attorney, Agent, or Firm*—Merchant, Gould, Smith, Edell, Welter & Schmidt, P.A.

[57] ABSTRACT

Sash lock for double hung windows which substantially limits movement of the sashes upon engagement of the sash lock. The sash lock also has an improved latching construction which results in a simple, easily manufactured latching portion.

19 Claims, 2 Drawing Sheets

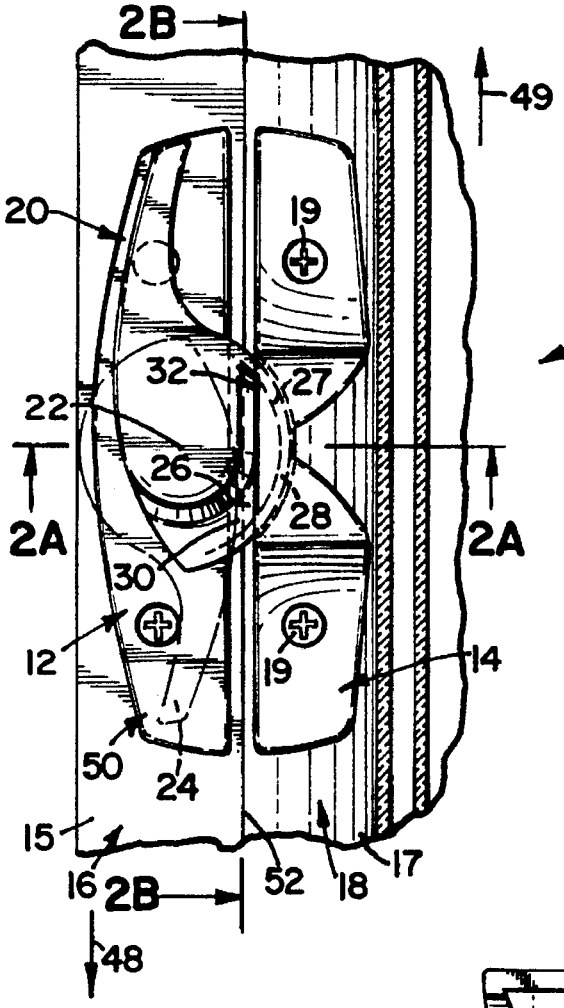
FIG. 1
FIG. 3B
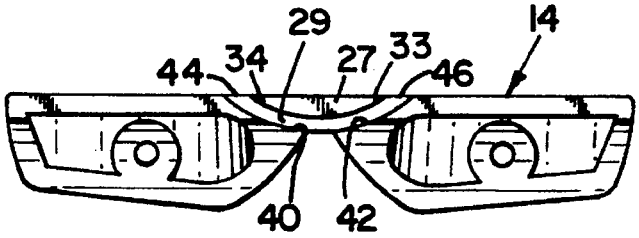
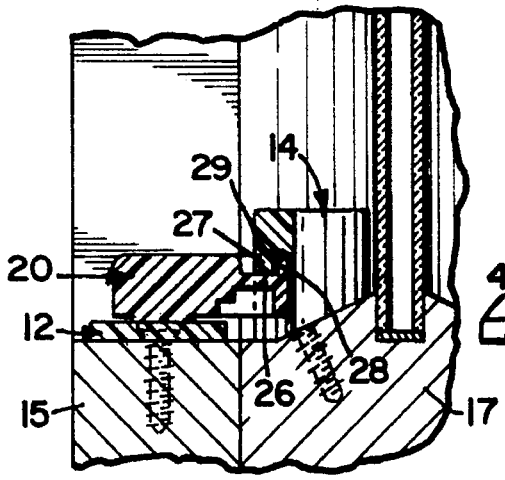
FIG. 2A
FIG. 3A
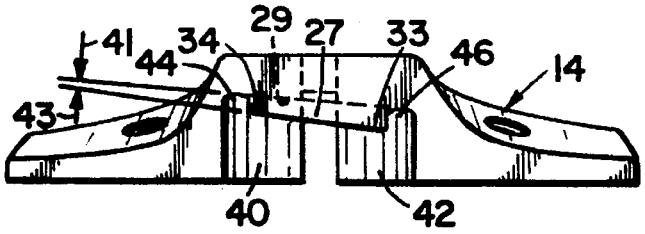
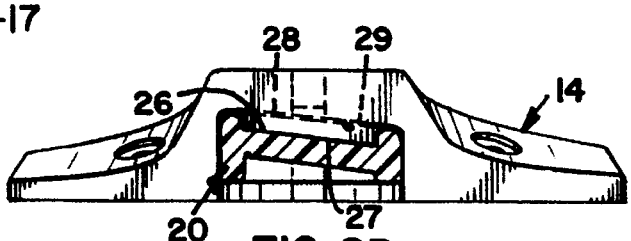
FIG. 2B

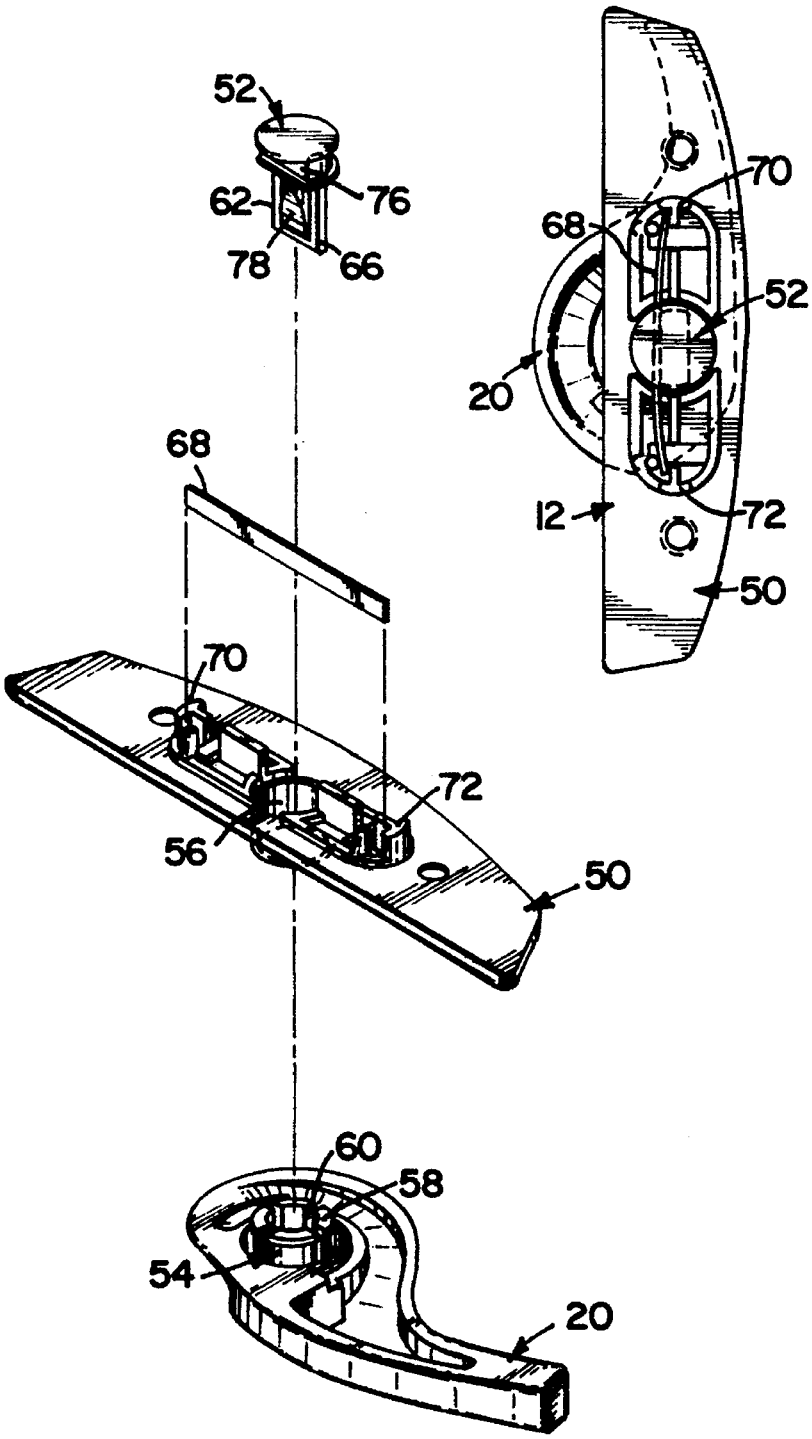
FIG.4
FIG.5
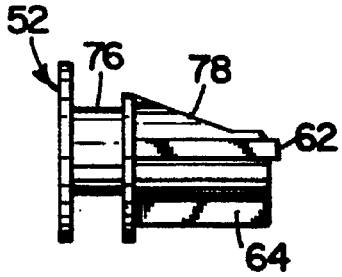
FIG. 6
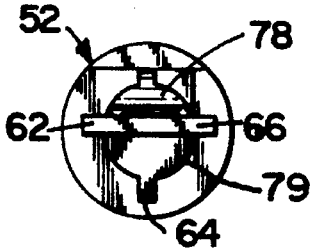
FIG. 7

SASH LOCK

This is a continuation of application Ser. No. 08/407,404, filed Mar. 17, 1995, which is a continuation of application Ser. No. 08,013,572, filed Feb. 4, 1993.

BACKGROUND OF THE INVENTION

1. Field of the Invention

This invention relates to an improved sash lock for double hung windows which self centers the sashes and substantially limits the movement of the sashes with respect to one another.

2. Description of Related Art

Sash locks for double hung windows are well known. Double hung windows are generally defined as two individual glass panels, each panel in a separate sash, with the two sashes moveable in a vertical plane. The sashes are mounted in a window frame, defined by jamb liners on the side, a head jamb on the top and a sill on the bottom. Typically, the sashes are counter-balanced by weights or balances, which provide for easier vertical movement of the sashes.

The sash is comprised of a top rail, side stiles and a bottom rail. Further, the bottom rail of the top sash is also called the upper check rail and the top rail of the bottom sash is called the lower check rail. The check rails are adjacent to one another when the sashes are locked and pass one another when the sashes are operated.

In order to prevent vertical movement of the sashes, locking mechanisms are placed on the check rails. The locking mechanisms typically have a latching portion and a keeper portion. The latching portion generally rotates and engages the keeper portion, thus preventing vertical movement of the sashes. Prior patents showing a variety of different sash locks include U.S. Pat. Nos. 110,733; 112,717; 126,754; 197,848; 564,426; 1,122,026; 2,422,723; 3,645,573, and 3,811,718.

In recent years, a new type of double hung window has been introduced, such as that marketed by Andersen Corporation commercially available under the trademark "D.C. Window." This new type of window allows the user to clean the outer surface of the window in an easy manner. The window has flexible side jamb liners such that the sash may be pulled inwardly, out of the side jamb liners, and positioned so that the window may be easily cleaned. Thereafter, the sash is pushed back into the side jamb liners and thus positioned in its operational mode.

A problem of prior sash locks is even after the sashes were locked, there was still movement of the sashes with respect to one another. This movement occurred in all directions, with the greatest movement often occurring in a lateral plane, resulting in a side to side movement of the sashes. Such movement is undesirable for numerous reasons. One problem encountered from such movement is the sashes would not fit correctly within the frame, thus resulting in air, moisture and wind leaks. Another problem encountered is safety. If the sashes were not tightly fit together, with minimal clearance or tolerance between the sashes, it is easier to force a wire or other instrument through the space and open the sash lock from the outside, thus allowing an intruder access to the dwelling. These problems have been accentuated with the advent of the tilt windows described above. As a result of the side jamb liners being flexible, the sashes can move even more than the sashes of ordinary double hung windows within the window frame. This has serious repercussions as to the weatherability and the safety of the windows. Thus there exists a need for a sash lock which limits movement of the sashes and provides for proper alignment of the sashes. There also exists a need for a sash lock which can be more easily and cost effectively manufactured.

SUMMARY OF THE INVENTION

The present invention relates to a sash lock for a double hung window. The sash lock comprises a latch portion and a keeper portion, (a) the latch portion comprising a pivotally secured arcuate member having a chamfered chamber defined by an outer flange extending from a first end of the arcuate member to a handle end of the latch portion, the handle extending obliquely from the latch portion, the pivotally secured arcuate member being pivotally attached to a latch base portion which may be secured to a first sash, (b) the keeper portion having a base portion which may be secured to a second sash, the keeper portion having an arcuate engaging shoulder and a flange engaging surface, the shoulder and flange engaging surface being configured such that the shoulder and flange engaging surface substantially engages the flange and the chamfered chamber respectively in a manner which substantially limits movement of the first sash with respect to the second sash.

The present invention also has an improved latching portion of the sash lock. The latching portion is easily manufactured and can be made from inexpensive, yet strong polymeric materials. The latching portion comprises:

(a) a base portion adapted such that it may be secured to a sash, the base portion having an annular opening therethrough;

(b) a latching arm which is rotatably mounted in the base portion, the arm having a hollow cylindrical engaging extension terminating in a flanged end, the extension comprising at least one slot extending length wise and through the flanged end, the slot allowing the engaging extension to be compressed to a reduced diameter such that the flanged end may be pushed through the annular opening;

(c) a mounting means which secures the arm to the base, the mounting means configured as a cylindrical pin having a first and second end, the first end insertable within the engaging extension and comprising at least one slot engaging flange which substantially fills the space defined by the slot, the second end having at least one recess defined by a first and second recess flange, the recess adapted to fit a retainer pin, the retainer pin secured to a bottom portion of the base portion, the retainer pin retaining the mounting means in position on the base portion, the first end adapted to be slidably fit over the retaining pin in one direction.

BRIEF DESCRIPTION OF THE DRAWINGS

FIG. 1 shows an overview of the sash lock of the present invention.

FIG. 2A shows a cross-section of the latching and keeper portions of the sash lock of the present invention taken through line 2A—2A FIG. 1.

FIG. 2B shows a cross-section taken generally through line 2B—2B of FIG. 1, showing the latching portion retained within the keeper portion.

FIG. 3A shows a frontal view of the keeper portion of the sash lock of the present invention.

FIG. 3B shows a bottom view of the keeper portion of the present invention.

FIG. 4 shows an exploded view of the latching portion of the sash lock of the present invention.

FIG. 5 shows a bottom view of the latching portion of the present invention.

FIG. 6 shows a side profile of a cylindrical pin of the present invention.

FIG. 7 shows a frontal view of a cylindrical pin of the present invention.

DETAILED DESCRIPTION OF THE PRESENT INVENTION

The present invention relates to an improved sash lock for double hung windows. As shown in FIG. 1, sash lock 10 comprises a latching portion 12 and a keeper portion 14. Latching portion 12 and keeper portion 14 are mounted to sashes 15 and 17 having check rails 16 and 18 respectively. Portions 12 and 14 can be mounted on check rails 16 and 18 in a variety of manners. Screws 19 are shown but any other such means may be used. The check rails 16 and 18 are typically comprised of wood, but may also be comprised of aluminum or some type of polymer or composite material as well. The sash lock of the present invention will work with any type of window sash which needs to be secured.

Latch portion 12 has arcuate handle portion 20 which extends from pivot point 22. As is evident from phantom line 24, handle portion 20 pivots around point 22 in a clockwise or counter-clockwise manner. Handle portion 20 comprises a chamfered chamber 26 defined by an outer flange 28. Both the chamber 26 and the flange 28 are angled from a low point 30 of handle portion 20 to a high point 32 of handle portion 20. The angle of inclination defined by these points can vary from one embodiment to another. The preferred angles will be discussed in greater detail below.

The chamfered chamber 26 is a grooved incline and is designed to accommodate an arcuate engaging shoulder 27 of keeper portion 14. The arcuate engaging shoulder 27 is best shown in FIGS. 3A and 3B. The arcuate engaging shoulder 27 is angled slightly such that a lower end 33 rises to a high end 34. As is evident from FIG. 1, arcuate engaging shoulder 27 is curved to match the chamfered chamber 26 such that the curve of shoulder 27 substantially abuts and contacts outer flange 28.

The keeper portion 14 also has a flange engaging surface 29 which is shown as a phantom line in FIG. 3A and shown actually in FIG. 3B. As is evident from the lines 41 and 43, in the preferred embodiment, arcuate engaging shoulder 27 and flange engaging surface 29 do not have the same degree of inclination. Although it is possible to have matching degrees of inclines, the intent and scope of the present invention is to match the degree of inclination of its mating surface on the opposing portion. Thus, arcuate engaging shoulder 27 must match the inclination and substantially engage the chamfered chamber 26 and additionally, flange engaging surface 29 must match the inclination and substantially engage flange 28 (as shown in FIG. 2B). As a result of this matching relationship between flange engaging surface 29 and the flange 28 and the arcuate engaging shoulder 27 and the chamfered chamber 26, the present invention provides a very stable sash lock system with minimal movement.

FIG. 2A shows a cut away along line 2A—2A of FIG. 1. As is evident from this figure, the present invention provides for a very tight fit between the latching portion 12 and keeper portion 14. Furthermore, in the preferred embodiment, the arcuate engaging shoulder 27 is in substantial contact with the bottom of chamfered chamber 26. Furthermore, as is shown in FIG. 3A, walls 40 and 42 are configured such that they substantially engage the handle portion 20. This engagement of walls 40 and 42 with the outer portion of handle 20 further prevents movement of the sash. In the preferred embodiment, walls 40 and 42 substantially abut or engage the outer portion or wall of handle portion 20.

In one preferred embodiment, the engaging shoulder 27 extends half the length of chamfered chamber 26. In the most preferred embodiment, the engaging shoulder 27 extends over half the length of chamfered chamber 26. In the preferred embodiment, the arcuate engaging shoulder 27 extends the full length of the plane defined by keeper portion 14 with small slots which allow the flange 28 to pass through engaging shoulder 27. These slots, identified as 44 and 46 in FIG. 3A, are no larger than is necessary to allow the flange 28 to reside closely within and pass through slots 44 and 46.

The sash lock 10 of the present invention may be comprised of metal or hard resilient polymeric material. Preferably, the sash lock 10 is a polymeric material commercially available under the designation VALOX 508μ from G. E. Plastics. In this manner, the sash lock 10 does not scratch. A problem encountered in previous sash locks is chamfered chamber 26 often becomes scratched and the finish is removed as a result of engaging shoulder 27 coming in contact with the inner portion of chamber 26. This is avoided when the sash lock 10 is comprised of molded plastic on account of the plastic being a solid color throughout.

The present sash lock 10 minimizes lateral movement of the sashes 15 and 17 as indicated by arrows 48 and 49. This is especially critical in the new line of windows which have flexible side jamb liners. Furthermore, for safety reasons, it is important that the space as indicated by line 52 is kept to a minimum such that wires or other devices used in unauthorized entries cannot be inserted between the sashes 15 and 17 such that the sash lock 10 can be popped open and the window raised. The present sash lock substantially minimizes any space between the resultant sashes and thus results in a more weather-tight and safe locking mechanism.

As is shown in FIGS. 4 through 7, sash lock 10 of the present invention also has an improved design for securing a handle portion 20 to base plate 50. The bottom of base plate 50 is not shown as having a "flush" bottom. However, the bottom could have a covering which fits over the bottom, thus resulting in a flush mounted sash lock. The improvement results from a unique fastening system which fastens handle portion 20 to base plate 50 with a mounting means configured as a cylindrical pin 52 which is further shown in FIGS. 6 and 7. Handle portion 20 has a cylindrical engaging extension 54 which fits through an annular space 56 through plate 50. The cylindrical engaging extension 54 has a flanged end 58 which is larger in diameter than the engaging extension 54. The engaging extension 54 has at least one slot 60 which extends length wise along engaging extension 54 and through flanged end 58. In the preferred embodiment, there are four such slots 60 which extend lengthwise along the cylindrical engaging extension 54.

In order to secure handle portion 20 onto base plate 50, cylindrical engaging extension 54 is reduced in diameter by compressing the extension 54 by reducing the space provided between slots 60 which allows the extension 54 to be pushed through annular opening 56 such that the flanged end 58 is exposed through annular opening 56. Thereafter, cylindrical pin 52 is inserted into engaging extension 54. As is shown in FIG. 7, pin 52, in the preferred embodiment, has four slot engaging flanges 62, 64 and 66 and the slot engaging flange defined at the end of 78. These slot engaging flanges are designed to fill the slots 60 of cylindrical engaging extension 54. Upon filling the slots 60, the cylindrical engaging extension 54 cannot be compressed in diameter because of the flanges in combination with diameter 79. The flanges work in combination with diameter 79 to prevent extension 54 from collapsing or pulled back through annular space 56.

After pin 52 is positioned in place in plate 50, the pin 52 is secured by retaining pin 68 which is positioned between post configurations 70 and 72 and is fit within a recess 76 of cylindrical pin 52. In the preferred embodiment, the recess 76 has two flattened heads, such that upon rotation of handle portion 20 there are two "locking" positions in which there will be no free movement of handle portion 20. Cylindrical pin 52, in the preferred embodiment, also has a sloped or beveled face 78 which provides for easy assembly of the latch portion. In this manner, handle portion 20 is pushed in contact with base plate 50, with cylindrical engaging extension 54 pushed through annular opening 56. The retaining pin 68 is thereafter placed between posts 70 and 72. Post configuration 70 and 72 should have heads which overlap a portion of retaining pin 68. Cylindrical pin 52 is thereafter inserted into cylindrical engaging extension 54, with the beveled face 78 being pushed by retaining pin 68, until retaining pin 68 fits within recess 76 of cylindrical pin 52. This provides for quick easy assembly and does not require welds, screws or other types of assembly techniques used in previous sash locks. Furthermore, with the slot engaging flanges 62, 64 and 66 preventing handle portion 20 to be pushed away from base plate 50, there is an incredibly tight fit with minimal movement of handle portion 20. Furthermore, it is virtually impossible without the use of tools to separate handle portion 20 from base plate 50. This provides further safety and weatherability to the window unit encompassing the sash lock of the present invention.

As will be apparent to those skilled in the art, various other modification can be carried out for the above disclosure without departing from the spirit and scope of the invention.

We claim:

1. A sash lock for a double hung window, said sash lock comprising a latch portion and a keeper portion, (a) said latch portion comprising a pivotally secured arcuate member having a chamfered chamber defined by an outer flange extending from a first end to a handle end of the pivotally secured arcuate member, said handle end including a handle extending obliquely therefrom, said pivotally secured arcuate member being pivotally attached to a latch base portion which may be secured to a first sash, (b) said keeper portion having a base portion which may be secured to a second sash, said keeper portion having an arcuate engaging shoulder and a flange engaging surface, said shoulder and flange engaging surface being configured such that, when at least a portion of said pivotally secured arcuate member is engaged within said keeper portion, said shoulder and flange engaging surface substantially engage said chamfered chamber and said flange respectively throughout said portion of said pivotally secured arcuate member in a manner which substantially limits movement of said first sash with respect to said second sash.

2. The sash lock of claim 1 wherein said pivotally secured arcuate member has an outer portion which is substantially engaged in an abutting relationship with walls of said keeper portion.

3. The sash lock of claim 1 wherein said first and second sash, after engagement of said keeper and latch portions, are substantially adjacent such that tolerance between said sashes substantially prevents unauthorized opening.

4. The sash lock of claim 1 wherein said shoulder extends over half the distance of the chamfered chamber.

5. The sash lock of claim 4 wherein said shoulder is substantially planar with a face of said keeper portion which is adjacent said latching portion.

6. The sash lock of claim 1 wherein said limited movement occurs in a lateral plane with respect to said sashes.

7. The sash lock of claim 1 wherein said limited movement occurs in a perpendicular plane with respect to said sashes.

8. The sash lock of claim 1 wherein an angle of said shoulder with respect to a plane defined by said second sash is greater than an angle of said flange engaging surface with respect to said plane.

9. The sash lock of claim 1, wherein said shoulder and flange engaging surface of said keeper portion have degrees of inclinations substantially matched to degrees of inclinations of said chamfered chamber and said flange, respectively, on said pivotally secured arcuate member.

10. A sash lock having a latching portion and a keeper portion, said latching portion comprising:

(a) a base portion adapted such that it may be secured to a sash, said base portion having an annular opening therethrough;

(b) a latching arm which is rotatably mounted in said base portion, said arm having a hollow cylindrical engaging extension terminating in a flanged end, said extension comprising at least one slot extending lengthwise and through the flanged end, said slot allowing the engaging extension to be compressed to a reduced diameter such that said flanged end may be pushed through said annular opening;

(c) a mounting means which secures said arm to said base, said mounting means configured as a cylindrical pin having a first and second end, the first end insertable within the engaging extension and comprising at least one slot engaging flange which substantially fills a space defined by said slot, said second end having at least one recess defined by a first and second recess flange, said recess adapted to fit a retainer pin, said retainer pin secured to a bottom portion of said base portion, said retainer pin retaining said mounting means in position on said base portion, said first end adapted to be slidably fit over the retaining pin in one direction.

11. The sash lock of claim 10 wherein said engaging extension comprises three slots and said cylindrical pin comprises three slot engaging flanges which fit within said three slots.

12. The sash lock of claim 10 wherein said cylindrical pin has two flattened opposing edges, each edge being engagable by said retaining pin.

13. The sash lock of claim 10 wherein said retaining pin is a thin metallic strip.

14. The sash lock of claim 10 wherein said sash lock is comprised of a polymeric material.

15. The sash lock of claim 10, wherein said engaging extension comprises four slots and said cylindrical pin comprises four slot engaging flanges which fit within said four slots.

16. A sash lock for a double hung window, said sash lock comprising:

(a) a latch portion including a latch base portion which may be secured to a first sash and an arcuate member pivotally attached to said latch base portion, said arcuate member including a chamfered chamber defined by an outer flange extending from a first end to a second end of said arcuate member; and (b) a keeper portion including a base portion which may be secured to a second sash, said keeper portion including an arcuate engaging shoulder and a flange engaging surface, wherein said shoulder and flange engaging surface have degrees of inclinations substantially matched to degrees of inclinations of said chamfered chamber and said flange, respectively, on said arcuate member; whereby said shoulder and flange engaging surface substantially engage said flange and said chamfered chamber in a manner which substantially limits relative movement between said first and second sashes.

17. A sash lock having a latching portion and a keeper portion, said latching portion comprising:

(a) a base portion adapted such that it may be secured to a sash, said base portion having an annular opening therethrough;

(b) a latching arm which is rotatably mounted in said base portion, said arm having a hollow engaging extension terminating in a flanged end, said extension comprising at least one slot extending lengthwise and through the flanged end, said slot allowing the engaging extension to be compressed to a reduced diameter such that said flanged end may be pushed through said annular opening; and (c) mounting means for securing said arm to said base, said mounting means including a pin having a first and second end, the first end insertable within the engaging extension and comprising at least one slot engaging flange which substantially fills a space defined by said slot to restrict compression of said engaging extension.

18. The sash lock of claim 17, wherein the retaining means comprises a retaining pin extending across an aperture in said base portion proximate said annular opening, and wherein said first end of said pin is adapted to be slidably fit over said retaining pin in one direction.

19. A sash lock having a latching portion and a keeper portion, said latching portion comprising:

(a) a base portion adapted to be secured to a sash, said base portion having an annular opening therethrough;

(b) a latching arm rotatably mounted in said base portion, said arm having an engaging extension projecting through said annular opening; and (c) mounting means for securing said arm to said base, said mounting means including a pin having a first and second end, the first end insertable within the engaging extension, said second end having at least one recess defined by first and second recess flanges, wherein said recess is adapted to fit a retaining means, secured to a bottom portion of said base portion, for engaging said recess of said pin and retaining said pin in said engaging extension, thereby retaining said latching arm in position on said base portion.

* * * * *